US007355574B1

(12) United States Patent
Leon et al.

(10) Patent No.: US 7,355,574 B1
(45) Date of Patent: Apr. 8, 2008

(54) OLED DISPLAY WITH AGING AND EFFICIENCY COMPENSATION

(75) Inventors: Felipe A. Leon, Rochester, NY (US); Gary Parrett, Rochester, NY (US); Christopher J. White, Avon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/626,563

(22) Filed: Jan. 24, 2007

(51) Int. Cl.
*G09G 3/32* (2006.01)

(52) U.S. Cl. ..... 345/82; 345/92; 345/101; 345/212; 345/77

(58) Field of Classification Search ..... 345/82, 345/76–78, 90–92, 101, 102, 204, 207, 211, 345/212, 214, 55, 63; 315/169.3, 169.4
See application file for complete search history.

(56) References Cited

U.S. PATENT DOCUMENTS 6,414,661 B1 7/2002 Shen et al.
6,456,016 B1 9/2002 Sundahl et al.
6,504,565 B1 1/2003 Narita et al.
6,995,519 B2 2/2006 Arnold et al.
2002/0167474 A1 11/2002 Everitt
2003/0098828 A1* 5/2003 Hunter et al. ..... 345/76
2003/0122813 A1 7/2003 Ishizuki et al.

FOREIGN PATENT DOCUMENTS

JP 2002-278514 9/2002

* cited by examiner

*Primary Examiner*—Tuyet Vo
(74) *Attorney, Agent, or Firm*—Raymond L. Owens

(57) ABSTRACT

Compensated drive circuit adjusting for changes in the threshold voltage of a drive transistor and for aging of an OLED device, comprising: a data line carrying analog data representative of the brightness level, and a select line; the drive transistor connected to a power supply and to the OLED device such that when the select line is activated and a voltage from the data line is applied to the gate electrode of such transistor and current proportional to the applied voltage will flow through the drain and source electrodes through the OLED device; circuitry for measuring first and second parameters associated with the drive circuitry and responsive to the measured first and second parameters for computing offset voltages to adjust for changes in the threshold voltage of the drive transistors and for aging of the OLED device.

6 Claims, 8 Drawing Sheets

OLED DISPLAY WITH AGING AND EFFICIENCY COMPENSATION

FIELD OF THE INVENTION

The present invention relates to solid-state OLED flat-panel displays and more particularly to such displays, which compensate for the aging of the organic light emitting display components.

BACKGROUND OF THE INVENTION

Solid-state organic light emitting diode (OLED) displays are of great interest as a superior flat-panel display technology. These displays utilize current passing through thin films of organic material to generate light. The color of light emitted and the efficiency of the energy conversion from current to light are determined by the composition of the organic thin-film material. Different organic materials emit different colors of light. However, as the display is used, the organic materials in the display age and become less efficient at emitting light. This reduces the lifetime of the display. The differing organic materials can age at different rates, causing differential color aging and a display whose white point varies as the display is used. In addition, each individual pixel can age at a different rate than other pixels resulting in display nonuniformity. Further, some circuitry elements, e.g. amorphous silicon transistors, are also known to exhibit aging effects.

The rate at which the materials age is related to the amount of current that passes through the display and, hence, the amount of light that has been emitted from the display. One technique to compensate for this aging effect in polymer light emitting diodes is described in U.S. Pat. No. 6,456,016 by Sundahl et al. This approach relies on a controlled reduction of current provided at an early stage of use followed by a second stage in which the display output is gradually decreased. This solution requires that the operating time of the display be tracked by a timer within the controller, which then provides a compensating amount of current. Moreover, once a display has been in use, the controller must remain associated with that display to avoid errors in display operating time. This technique has the disadvantage of not representing the performance of small-molecule organic light emitting diode displays well. Moreover, the time the display has been in use must be accumulated, requiring timing, calculation, and storage circuitry in the controller. Also, this technique does not accommodate differences in behavior of the display at varying levels of brightness and temperature and cannot accommodate differential aging rates of the different organic materials.

U.S. Pat. No. 6,414,661 B1 by Shen et al. describes a method and associated system to compensate for long-term variations in the light-emitting efficiency of individual organic light emitting diodes (OLEDs) in an OLED display by calculating and predicting the decay in light output efficiency of each pixel based on the accumulated drive current applied to the pixel. The method derives a correction coefficient that is applied to the next drive current for each pixel. This technique requires the measurement and accumulation of drive current applied to each pixel, requiring a stored memory that must be continuously updated as the display is used, and therefore requiring complex and extensive circuitry.

U.S. Patent Application 2002/0167474 A1 by Everitt describes a pulse width modulation driver for an OLED display. One embodiment of a video display comprises a voltage driver for providing a selected voltage to drive an organic light emitting diode in a video display. The voltage driver can receive voltage information from a correction table that accounts for aging, column resistance, row resistance, and other diode characteristics. In one embodiment of the invention, the correction tables are calculated prior to and/or during normal circuit operation. Since the OLED output light level is assumed to be linear with respect to OLED current, the correction scheme is based on sending a known current through the OLED diode for a duration sufficiently long to allow the transients to settle out, and then measuring the corresponding voltage with an analog-to-digital converter (A/D) residing on the column driver. A calibration current source and the A/D can be switched to any column through a switching matrix. This design requires the use of a integrated, calibrated current source and A/D converter, greatly increasing the complexity of the circuit design.

U.S. Pat. No. 6,504,565 B1 by Narita et al. describes a light-emitting display which includes a light-emitting element array formed by arranging a plurality of light-emitting elements, a driving unit for driving the light-emitting element array to emit light from each of the light-emitting elements, a memory unit for storing the number of light emissions for each light-emitting element of the light-emitting element array, and a control unit for controlling the driving unit based on the information stored in the memory unit so that the amount of light emitted from each light-emitting element is held constant. An exposure display employing the light-emitting display, and an image forming apparatus employing the exposure display are also disclosed. This design requires the use of a calculation unit responsive to each signal sent to each pixel to record usage, greatly increasing the complexity of the circuit design.

JP 2002278514 A by Numeo Koji describes a method in which a prescribed voltage is applied to organic EL elements by a current-measuring circuit and the current flows are measured, and a temperature measurement circuit estimates the temperature of the organic EL elements. A comparison is made with the voltage value applied to the elements, the flow of current values and the estimated temperature, the changes due to aging of similarly constituted elements determined beforehand, the changes due to aging in the current-luminance characteristics, and the temperature at the time of the characteristics measurements for estimating the current-luminance characteristics of the elements. Then, the total sum of the amount of currents being supplied to the elements in the interval during which display data are displayed is changed, which can provide the luminance that is to be originally displayed, based on the estimated values of the current-luminance characteristics, the values of the current flowing in the elements, and the display data. This design presumes a predictable relative use of pixels and does not accommodate differences in actual usage of groups of pixels or of individual pixels. Hence, correction for color or spatial groups is likely to be inaccurate over time. Moreover, the integration of temperature and multiple current sensing circuits within the display is required. This integration is complex, reduces manufacturing yields, and takes up space within the display.

U.S. Patent Application 2003/0122813 A1 by Ishizuki et al. discloses a display panel driving device and driving method for providing high-quality images without irregular luminance even after long-time use. The light-emission drive current flowing is measured while each pixel successively and independently emits light. Then the luminance is corrected for each input pixel data based on the measured drive current values. According to another aspect, the drive voltage is adjusted such that one drive current value becomes equal to a predetermined reference current. In a further aspect, the current is measured while an off-set current, corresponding to a leak current of the display panel, is added to the current output from the drive voltage generator circuit, and the resultant current is supplied to each of the pixel portions. This design presumes an external current detection circuit sensitive enough to detect the current changes due to a single pixel's power usage. The measurement techniques are iterative, and therefore slow.

Arnold et al., in U.S. Pat. No. 6,995,519, teach a method of compensating for aging of an OLED device. This method assumes that the entire change in device luminance is caused by changes in the OLED emitter. However, when the drive transistors in the circuit are formed from amorphous silicon (a-Si), this assumption is not valid, as the threshold voltage of the transistors also changes with use. The method of Arnold will not provide complete compensation for OLED efficiency losses in circuits wherein transistors show aging effects. Additionally, when methods such as reverse bias are used to mitigate a-Si transistor threshold voltage shifts, compensation of OLED efficiency loss can become unreliable without appropriate tracking/prediction of reverse bias effects, or a direct measurement of the OLED voltage change or transistor threshold voltage change.

There is a need therefore for a more complete compensation approach for organic light emitting diode displays.

SUMMARY OF THE INVENTION

It is therefore an object of the present invention to compensate for aging and efficiency changes in OLED emitters in the presence of transistor aging.

This object is achieved by a compensated drive circuit adjusting for changes in the threshold voltage of the drive transistor and aging of an OLED device, comprising:

a. a data line carrying analog data representative of the brightness level desired from the OLED device, and a select line;

b. a drive transistor connected to a power supply and to the OLED device such that when the select line is activated and a voltage from the data line is applied to the gate electrode of such transistor and current proportional to the applied voltage will flow through the drain and source electrodes through the OLED device;

c. means for measuring first and second parameters associated with the drive circuitry, the first parameter being a function of the voltage across the OLED device, and the second parameter being a function of the current passing through the OLED; and d. means responsive to the measured first and second parameters for computing offset voltages to be applied to the data line analog voltages to adjust for changes in the threshold voltage of the drive transistors and for aging of the OLED device.

ADVANTAGES

An advantage of this invention is an OLED display that compensates for the aging of the organic materials in the display wherein circuitry aging is also occurring, without requiring extensive or complex circuitry for accumulating a continuous measurement of light-emitting element use or time of operation. It is a further advantage of this invention that it uses simple voltage and current measurement circuitry. It is a further advantage of this invention that it performs the compensation based on OLED changes, without being confounded with changes in driving transistor properties. It is a further advantage of this invention that compensation for changes in driving transistor properties can be performed with compensation for the OLED changes, thus providing a complete compensation solution.

DETAILED DESCRIPTION OF THE INVENTION

Figure 1A:
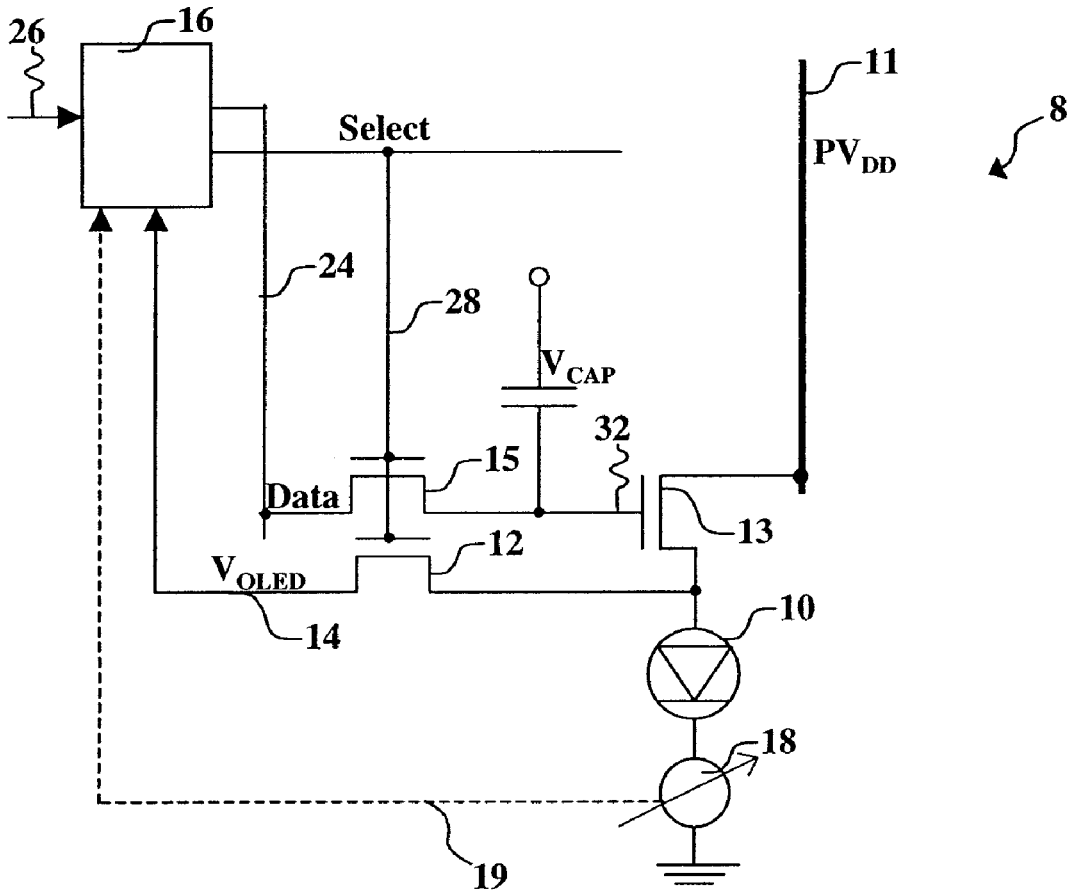
FIG. 1A is a schematic diagram of one embodiment of a compensated drive circuit adjusting for changes in the threshold voltage of a drive transistor and for aging of an OLED device according to the present invention.
Figure 1B:
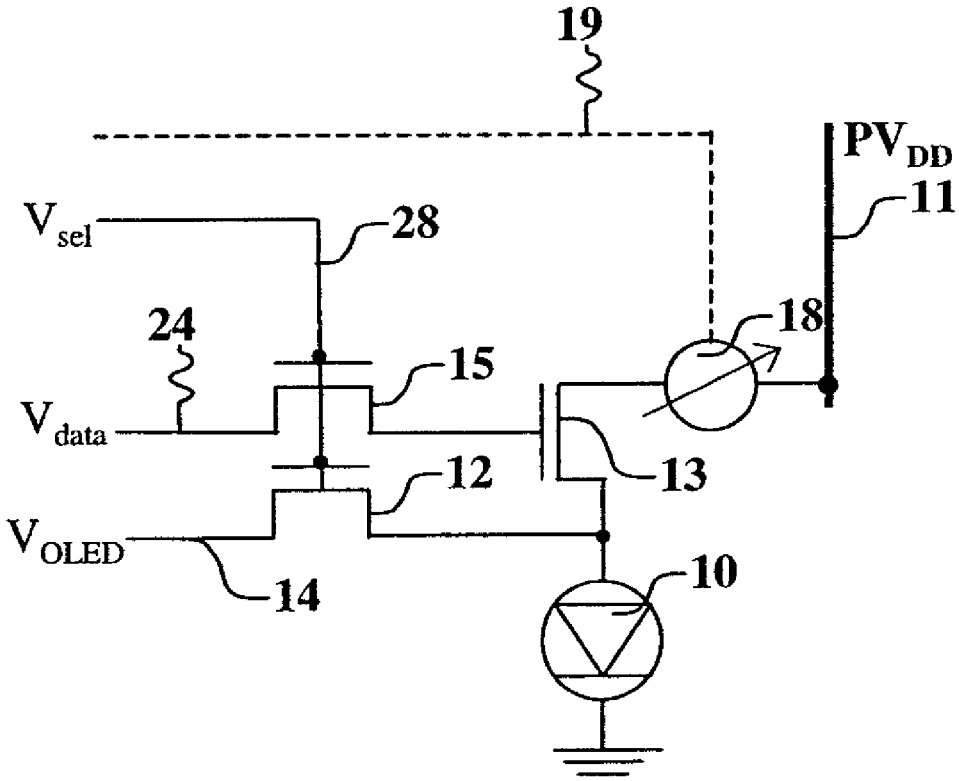
FIG. 1B is a schematic diagram of an alternate embodiment of a compensated drive circuit according to the present invention.

Turning now to FIG. 1A, there is shown a schematic diagram of one embodiment of a compensated drive circuit 8 adjusting for changes in the threshold voltage of a drive transistor and aging of an OLED device according to the present invention. Drive circuit 8 includes OLED device 10, drive transistor 13, a data line 24 that carries analog data (e.g. voltage) representative of the brightness level desired from OLED device 10, switch transistor 15, and a select line 28. An OLED display can comprise an array of drive circuits 8. Drive transistor 13 is connected to power supply 11 (PVDD) and to OLED device 10. Drive transistor 13 is an amorphous silicon transistor or other transistor whose properties change with time and/or use. When select line 28 is activated, switch transistor 15 is activated and a voltage from data line 24 is applied to gate electrode 32 of drive transistor 13 so that current proportional to the applied data line voltage will flow through the drain and source electrodes of drive transistor 13 and through OLED device 10. A voltage sensing circuit for each OLED device 10 includes a switch transistor 12 wherein the gate electrode is also connected to select line 28 for measuring a first parameter, e.g. first parameter signal 14, which is associated with the drive circuitry. The first parameter can be e.g. a voltage output that is a function of the voltage across OLED device 10, which will be referred to herein as $V_{OLED}$. Similarly, a current measurement device 18 (e.g. a load resistor, a current mirror, or other such devices known in the art) connected between OLED device 10 and the ground can allow the measurement of a second parameter that is a function of the current passing through OLED device 10, generating second parameter signal 19. Controller 16 controls OLED device 10 via the drive circuitry. Controller 16 is responsive to input signal 26 and the measured first and second parameters for computing offset voltages to be applied to the analog voltage of data line 24 to adjust for changes due to the aging of OLED device 10 and can also adjust for changes in the threshold voltage of drive transistor 13. Some useful non-limiting examples of controller 16 include a microprocessor, a field-programmable gate array (FPGA), and an application-specific integrated circuit (ASIC). FIG. 1B is a schematic diagram of a portion of an alternate embodiment of a compensated drive circuit according to the present invention. In this embodiment, current measurement device 18 is connected to power supply 11 rather than the ground. In the embodiments shown in FIGS. 1A and 1B, separate first and second parameter signals 14 and 19 can be provided for each drive circuit 8 or group of drive circuits to be measured.

Figure 2:
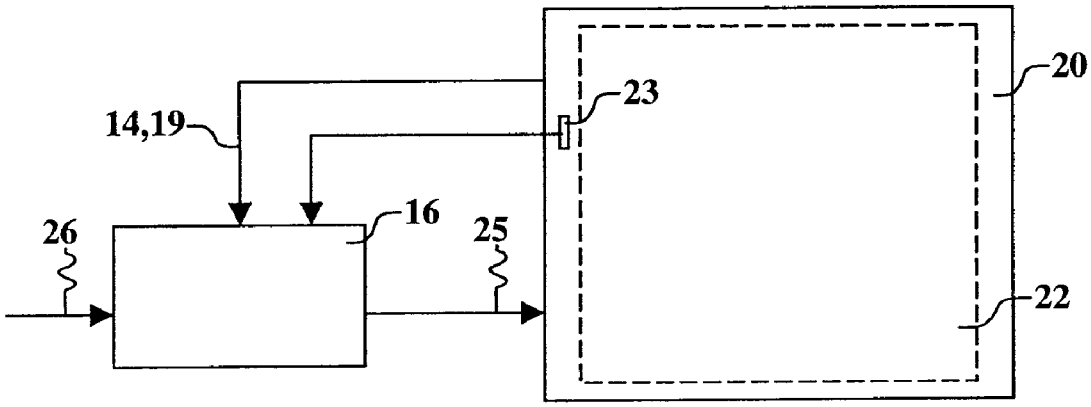
FIG. 2 is a schematic diagram of an OLED display according to the present invention.

Referring to FIG. 2, there is shown a schematic diagram of an OLED display according to the present invention. A display is formed on a substrate 20 including an array 22 of OLED devices 10 responsive to corrected control signals 25 produced by controller 16 and placed on data lines. The controller 16 is responsive to input signal 26 and first and second parameter signals 14 and 19, respectively. The parameter signals are shown as a single line for convenience of illustration. Control devices on substrate 20 for driving OLED devices 10, for example thin-film transistors and capacitors, can be provided and are well known in the art, as are suitable controllers 16.

According to one embodiment of the present invention, controller 16 can selectively activate all or a portion of OLED devices 10 in array 22 and can respond to the first and second parameter signals for computing an offset voltage for the selectively activated OLED devices 10. Controller 16 applies the correction signal to input signals 26 to produce corrected control signals 25 that compensate for the changes in the threshold voltage of drive transistor 13, resistance of OLED device 10, and efficiency of OLED device 10. This compensation will be described further below.

In one embodiment, the present invention can be applied to a color image display comprising an array of pixels, each pixel including a plurality of different colored OLED devices 10 (e.g. red, green and blue) that are individually controlled by controller 16 to display a color image. Colored OLED devices 10 can be formed by different organic light-emitting materials that emit light of different colors, or alternatively they can all be formed by the same organic light-emitting materials (e.g. white) with color filters over the individual elements to produce the different colors. In another embodiment, the OLED devices 10 are individual graphic elements within a display and may not be organized in a regular array (not shown). In either embodiment, the light-emitting elements can have either passive- or active-matrix control and can either have a bottom-emitting or top-emitting architecture.

Figure 3A:
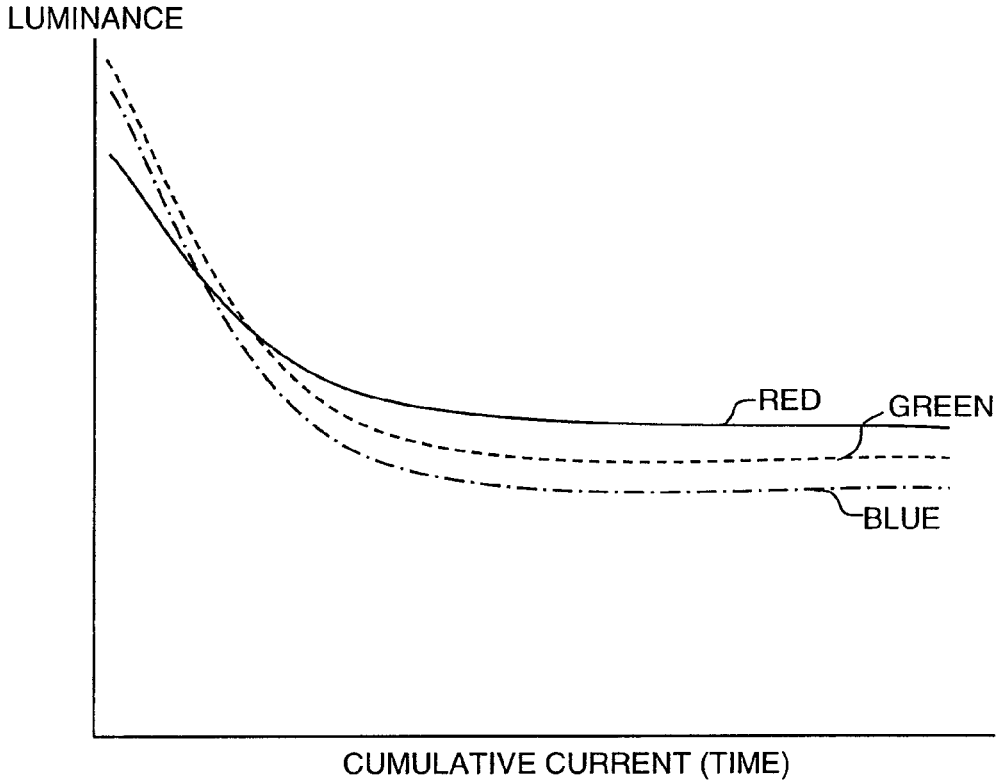
FIG. 3A is a diagram illustrating the effect of aging of an OLED device on luminance efficiency.

Turning now to FIG. 3A, there is shown a diagram illustrating the effect of aging of an OLED device on luminance efficiency as current is passed through the OLED devices. The three curves represent typical performance of different light emitters emitting differently colored light (e.g. R,G,B representing red, green and blue light emitters, respectively) as represented by luminance output over time or cumulative current. The decay in luminance between the differently colored light emitters can be different. The differences can be due to different aging characteristics of materials used in the differently colored light emitters, or due to different usages of the differently colored light emitters. Hence, in conventional use, with no aging correction, the display can become less bright and the color of the display—in particular the white point—can shift.

Figure 3B:
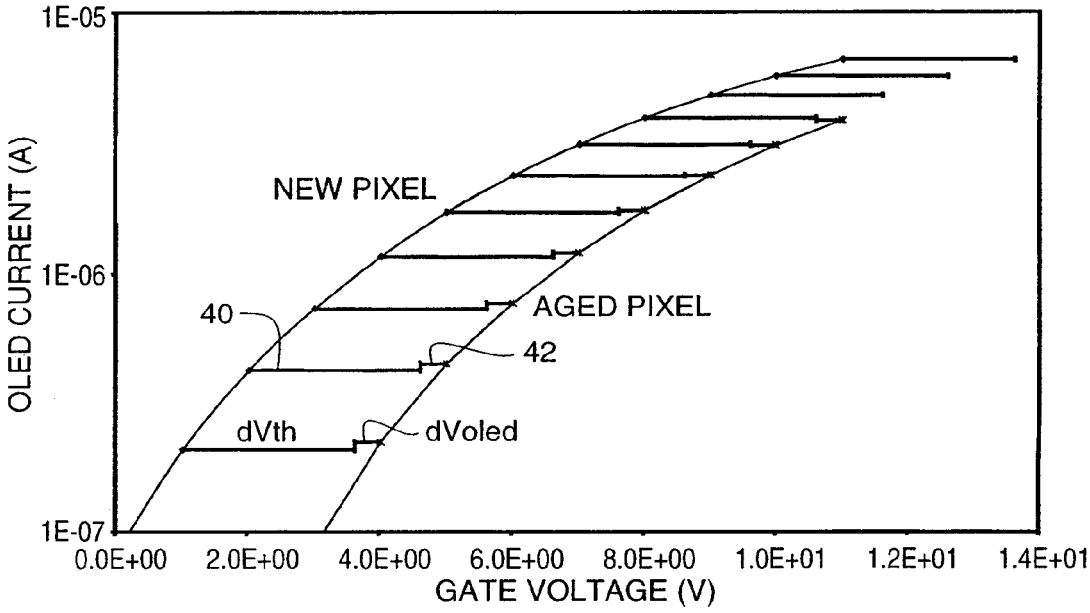
FIG. 3B is a diagram illustrating the effect of aging of an OLED device or a drive transistor on device current.

Turning now to FIG. 3B, there is shown a diagram illustrating the effect of aging of an OLED device or a drive transistor on device current. In describing OLED device resistance change, the horizontal axis of FIG. 3B represents the gate voltage at drive transistor 13, as shown in FIG. 1B. As the circuit ages, a greater voltage is required to obtain a desired current; that is, the curve moves by an amount ΔV. ΔV is the sum of the change in threshold voltage ($dV_{th}$, 40) and the change in OLED voltage ($dV_{OLED}$, 42), as shown. This change results in reduced performance. A greater gate voltage is required to obtained a desired current. The relationship between the OLED current, OLED voltage, and threshold voltage at saturation is:

$$I_{oled} = \frac{W\bar{\mu}C_0}{2L}(V_{gs} - V_t)^2 = \frac{K}{2}(V_g - V_{oled} - V_t)^2 \quad \text{(Eq. 1)}$$

where W is the TFT Channel Width, L is the TFT Channel Length, μ is the TFT mobility, $C_0$ is the Oxide Capacitance per Unit Area, $V_g$ is the gate voltage, $V_{gs}$ is voltage difference between gate and source of the drive transistor. For simplicity, we neglect dependence of μ on $V_{gs}$. It is necessary to measure both $V_{OLED}$ and $I_{OLED}$. If only the current were measured, one cannot determine if a current change were due to a change in $V_{OLED}$, a change in $V_{th}$, or some combination of the two. If only $V_{OLED}$ were measured, one cannot determine the relative changes due to aging of the OLED device and to current changes due to aging of the drive transistor.

Thus, three factors affect the luminance of the OLED device and change with age or use in the amorphous silicon drive circuit: 1) the threshold voltage of the drive transistor increases ($dV_{th}$), which reduces the current that flows through the drive circuit (shown in FIG. 3B); 2) the resistance across the OLED device increases, causing an increase in the voltage across the OLED device ($dV_{OLED}$) or a reduction in the current through the OLED device (also shown in FIG. 3B); and 3) the efficiency of the OLED device decreases, which decreases the light emitted at a given current (shown in FIG. 3A). By measuring the OLED voltage and the OLED current, one can determine (as shown in FIG. 3B and Eq. 1) the shift of the OLED curve, and therefore determine the shift in FIG. 3B due to a change in OLED device resistance (by computing $dV_{OLED}$) for an aged OLED device. A relationship has been found between the decrease in luminance efficiency of an OLED device and $dV_{OLED}$, that is, where the OLED luminance for a given current is a function of the change in $V_{OLED}$:

$$\frac{L_{OLED}}{L_{OLED}} = f(dV_{OLED}) \quad \text{(Eq. 2)}$$

Figure 6:
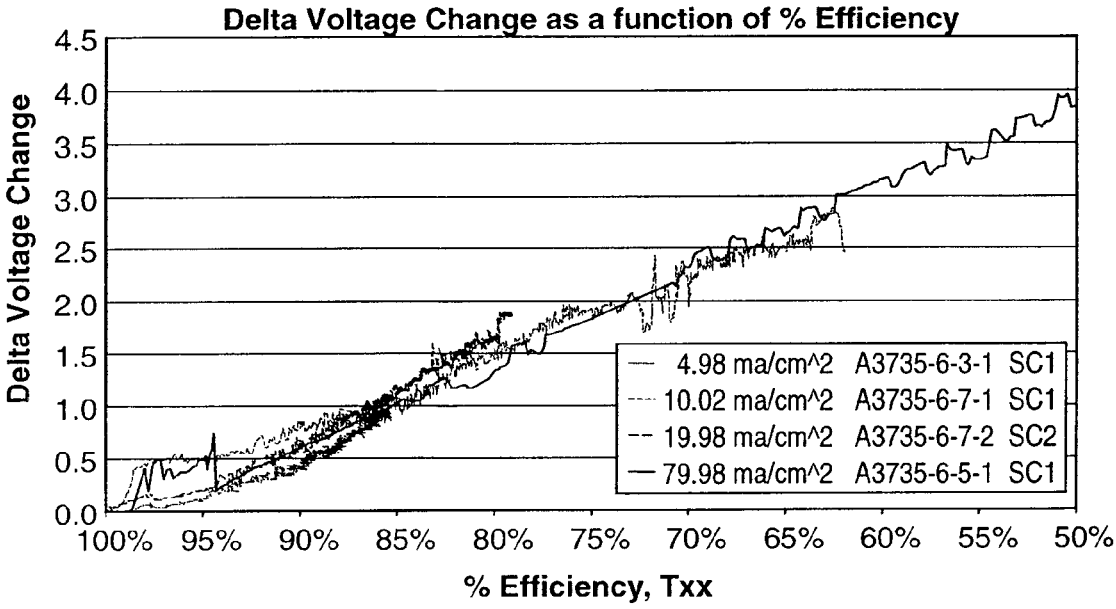
FIG. 6 is a graph showing the relationship between OLED efficiency and the change in OLED voltage.

An example of the relationship between luminance efficiency and $dV_{OLED}$ for one device is shown in the graph in FIG. 6. By measuring the luminance decrease and its relationship to ΔV with a given current, a change in corrected signal 25 necessary to cause the OLED device 10 to output a nominal luminance can be determined. This measurement can be done on a model system and thereafter stored in a lookup table or used as an algorithm. Controller 16 can include the lookup table or algorithm, which allows controller 16 to compute an offset voltage for each OLED device. The offset voltage is computed to provide corrections for changes in OLED current due to changes in the threshold voltage of drive transistor 13 and aging of OLED device 10, as well as providing a current increase to compensate for efficiency loss due to aging of OLED device 10, thus providing a complete compensation solution. These changes can be applied by the controller 16 to correct the light output to the nominal luminance value desired. By controlling the signal applied to the OLED device, an OLED device with a constant luminance output and increased lifetime at a given luminance is achieved.

Figure 4A:
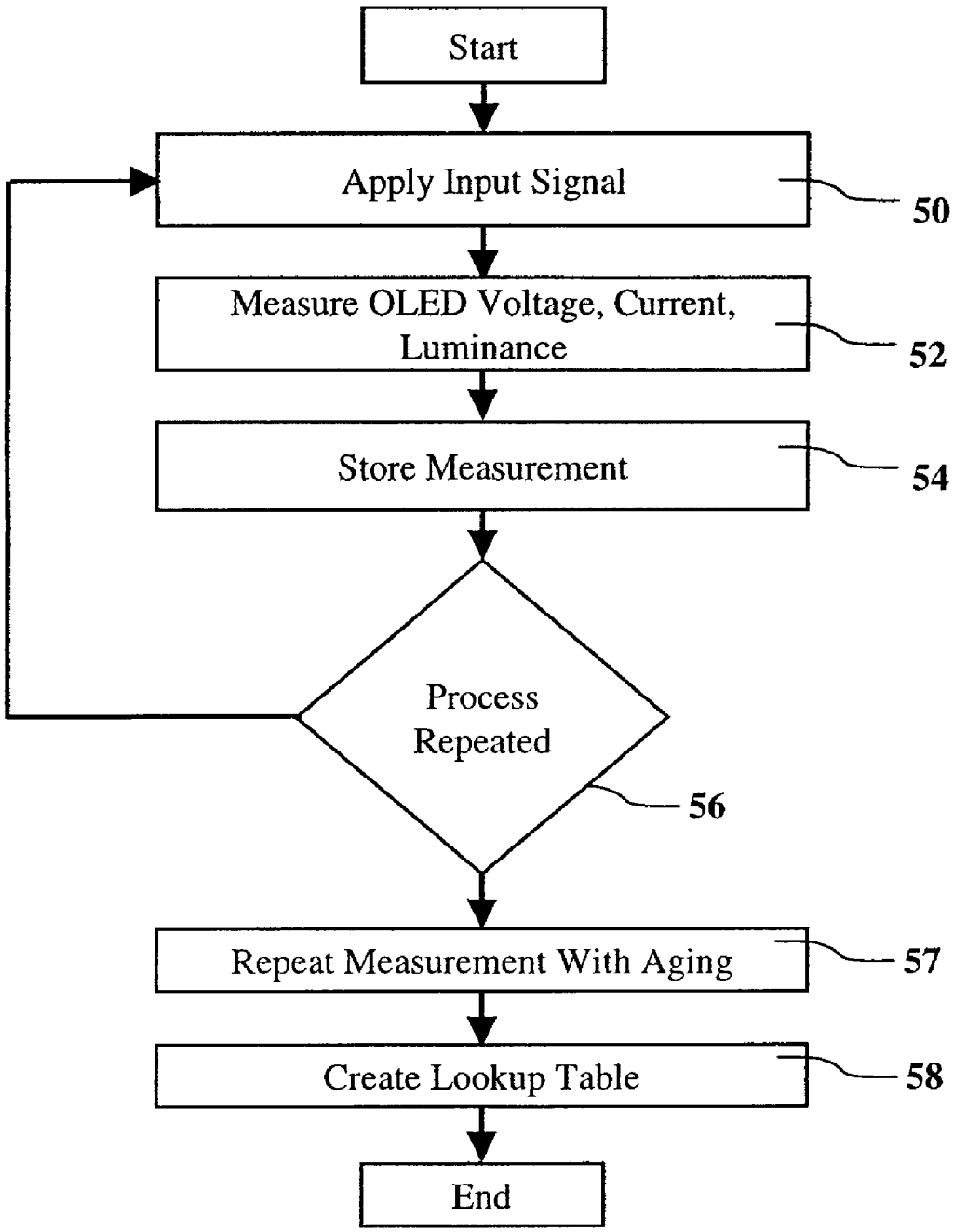
FIG. 4A is a flowchart illustrating a first portion of the use of the present invention.

Turning now to FIG. 4A, there is shown one embodiment of a first portion of the method of operation wherein the present invention adjusts for changes in the threshold voltage of the drive transistor and for aging of the OLED device. For this method, there is first provided a compensated drive circuit as described above, e.g. with a data line, select line, drive transistor, power supply, and OLED device. Before a display is used, a given input signal is applied (Step 50) to the one or more OLED devices 10, and the first and second parameters (e.g. the OLED voltage and the current) are measured, along with the luminance of OLED device 10 (Step 52). The measurements are stored in controller 16 or another convenient location (Step 54). The process is repeated (Step 56) wherein controller 16 activates each OLED device 10 at a plurality of different brightness levels for the range of luminance levels desired. This series of steps is repeated (Step 57) at various times after the OLED devices have been used to relate the change in luminance to the change in OLED voltage at a given current. Once the data is stored for each OLED device 10 for the duration of the device lifetime, the $dV_{OLED}$ can be determined using Eq. 1, and a lookup table or algorithm is created, using Eq. 2, relating $dV_{OLED}$ to the change in OLED efficiency (Step 58). This can then be used for correcting OLED displays of a similar nature, e.g. commercial units for which a series of luminance measurements is not practical. The correction can be applied using look-up tables using techniques well-known in the art.

Figure 4B:
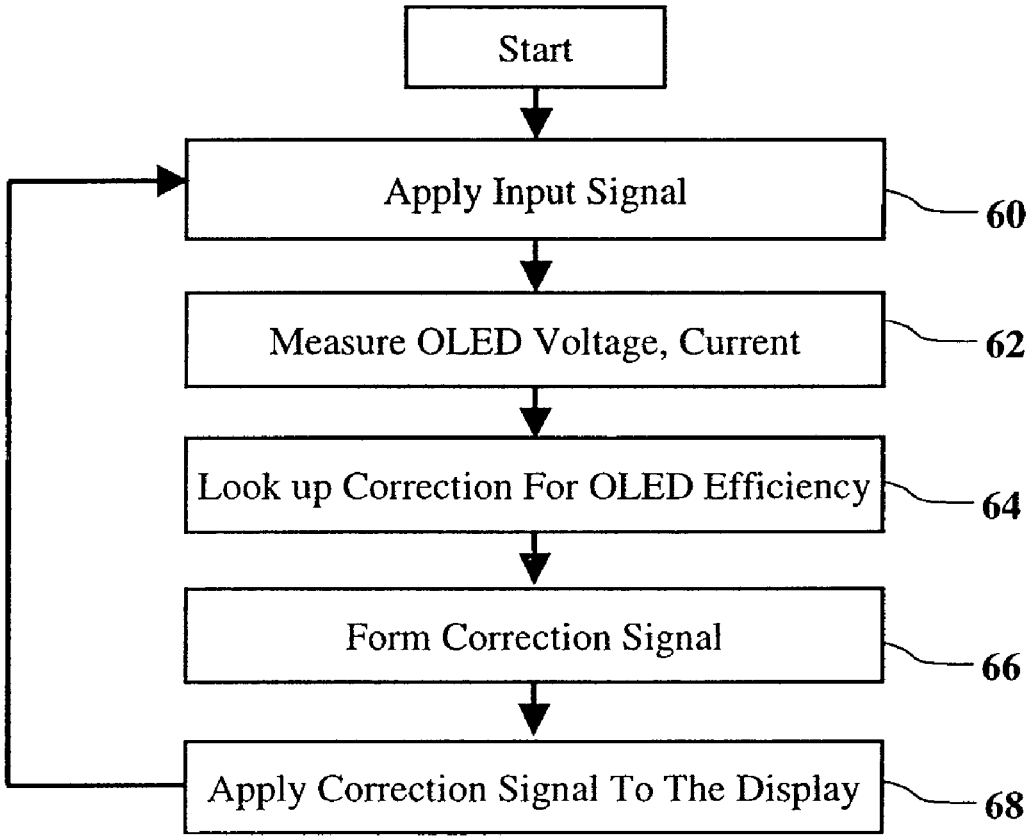
FIG. 4B is a flowchart illustrating a second portion of the use of the present invention.

Turning now to FIG. 4B, there is shown one embodiment of a second portion of the method of operation of the present invention, wherein the correction determined for an OLED display is put into use. While in use, an input signal is applied to controller 16 (Step 60), which sequentially activates individual OLED devices, and the first and second parameters (e.g. OLED voltage and current) are measured (Step 62). The OLED voltage and current provide a measure of the aging of the OLED device by providing the shift of the OLED characteristic curve. Controller 16 determines $dV_{OLED}$ and looks up the correction for OLED efficiency (Step 64) and computes an offset voltage to correct the input signal for each OLED device to form a corrected signal (Step 66) that corrects for loss of current (due to changes in the threshold voltage and aging of the OLED device) and for OLED efficiency loss. The corrected signal is applied to the display (Step 68). Thus, this method provides a complete compensation solution. This process can be done periodically to compensate for aging that may have occurred, for example after a predetermined period of time, or during a power-off or power-on routine. Subsequently, as each new input signal is applied, the controller forms a new corrected signal and applies the corrected signal to the display. Using the present invention, continuous monitoring of the display is obviated.

Over time the OLED and drive transistor materials will age, the resistance of the OLED devices will increase, and the threshold voltage will increase. At some point in time, controller 16 will no longer be able to provide a sufficient corrected signal and the light emitters will no longer meet their brightness or color specification. However, the light emitters will continue to operate as their performance declines, thus providing a graceful degradation. Moreover, the time at which the light emitters can no longer meet their specification can be signaled to a user of the display when a large correction is calculated, providing useful feedback on the performance of the display. The controller can allow the display luminance to degrade slowly while reducing any differential color shift. Alternatively, the controller can reduce the pixel-to-pixel variability while allowing the luminance to slowly decline with use. These techniques can also be combined to allow the display to degrade slowly while reducing differential color shift and allowing the luminance to slowly decline over time. The rate of luminance loss with age can be selected based on the anticipated usage.

OLED light emitters have associated driving circuits. The present invention can be applied to a wide variety of light emitter circuitry including voltage control (as shown in FIG. 1A) or current control (not shown). Current control techniques provide a more uniform light emitter performance but are more complex to implement or to correct.

The present invention can be constructed simply, requiring only (in addition to a conventional display controller) a voltage-measurement circuit, a current-measurement circuit, an additional line to each OLED or column of OLEDs, a transformation structure for the model to perform the signal correction (for example a lookup table or amplifier), and a calculation circuit to determine the correction for the given input signal. No current accumulation or time information is necessary. Although the OLED devices must be periodically removed from use to perform the correction, the period between corrections can be quite large, for example days or tens of hours of use, and the correction can be done at a time unnoticeable to an end-user, e.g. during power-off. Depending on the specific implementation, the correction calculation process can take only a few milliseconds so that the effect on any user is limited. Alternatively, the correction calculation process can be performed in response to a user signal supplied to the controller.

The present invention can be used to correct for changes in color of a color light emitter display. As noted in reference to FIG. 3A, as current passes through the various light emitting elements in the pixels, the materials for each color emitter can age differently. By creating groups comprising all of the light emitting elements of a given color, and measuring the average voltage used by the display for that group, a correction for the light emitting elements of the given color can be calculated. A separate model can be applied for each color, thus maintaining a consistent color for the display. This technique will work for both displays that rely on emitters of different colors, or on a single, white emitter together with color filter arrays arranged to provide colored light emitting elements. In the latter case, the correction curves representing the loss of efficiency for each color are identical or nearly so. However, the use of the colors may not be the same, so that a separate correction for each color can still be useful to maintain a constant luminance and display white point for the display.

The present invention can be extended to include complex relationships between the corrected image signal, the measured voltage, and the aging of the materials. Multiple input signals can be used corresponding to a variety of display luminance outputs. For example, a different input signal can correspond to each display output brightness level. When periodically calculating the correction signals, a separate correction signal can be obtained for each display output brightness level by using different given input signals. A separate correction signal is then employed for each display output brightness level required. As before, this can be done for each light emitter grouping, for example different light emitter color groups. Hence, the correction signals can correct for each display output brightness level for each color as each material ages.

Individual light emitters and input signals can be used to calculate the correction signals for the display providing spatially specific correction. In this way, the correction signals can apply to specific light emitters so that if a subset of light emitters age more rapidly, for example, if they are used more heavily (as an icon in a graphic user interface might), they can be corrected differently from other light emitters. Therefore, the present invention can correct for the aging of specific light emitters or groups of spatially distinct light emitters, and/or groups of colored light emitters. It is only necessary that a correction model be empirically derived for aging of each light emitter or group of light emitters and that a periodic correction signal calculation be performed by driving the light emitters to be corrected.

OLED displays dissipate significant amounts of heat and become quite hot when used over long periods of time. As described by Arnold et al., there is a strong relationship between temperature and current used by the displays. Therefore, the output of the OLED device can change with temperature. If the display has been in use for a period of time, the temperature of the display may need to be taken into account in calculating the correction signal. If it is assumed that the display has not been in use, or if the display is cooled, it can be assumed that the display is at a predetermined ambient temperature, for example room temperature. If the correction signal model was determined at that temperature, the temperature relationship can be ignored. If the display is calibrated at power-up and the correction signal model was determined at ambient temperature, this is a reasonable assumption. For example, mobile displays with a relatively frequent and short usage profile might not need temperature correction. Display applications for which the display is continuously on for longer periods, for example monitors, televisions, or lamps, might require temperature accommodation, or can be corrected on power-up to avoid display temperature issues.

If the display is calibrated at power-down, the display can be significantly hotter than the ambient temperature, and it is preferred to include the temperature effect in computing the offset voltage. This can be done by measuring the temperature of the display by way of a temperature sensor, for example with a thermocouple 23 (see FIG. 2) placed on the substrate or cover of the display, or a temperature sensing element, such as a thermistor, integrated into the electronics of the display. The temperature sensor generates a temperature signal, and controller 16 can be responsive to the temperature signal. For displays that are constantly in use, the display is likely to be operated significantly above ambient temperature. The operational temperature of the display can be taken into account for the display calibration and can also be used to determine the likely rate of pixel aging. An estimate of the rate of pixel aging can be used to select an appropriate correction factor for the display device.

To further reduce the possibility of complications resulting from inaccurate current readings or inadequately compensated display temperatures, changes to the correction signals applied to the input signals can be limited by the controller. Any change in correction can be limited in magnitude, for example to a 5% change. A calculated correction signal might also be restricted to be monotonically increasing, since the aging process does not reverse. Correction changes can also be averaged over time, for example an indicated correction change can be averaged with one or more previous value(s) to reduce variability. Alternatively, an actual correction can be made only after taking several readings. For example, every time the display is powered on, a corrections calculation is performed and a number of calculated correction signals (e.g. 10) are averaged or used in a weighted averaging method to produce the actual correction signal that is applied to the display.

The corrected image signal can take a variety of forms depending on the OLED display. For example, if analog voltage levels are used to specify the signal, the correction will be an offset voltage. This can be done using amplifiers as known in the art. In a second example, if digital values are used, for example corresponding to a charge deposited at an active-matrix light-emitting element location, a lookup table can be used to convert the digital value to another digital value as well known in the art. In a typical OLED display, either digital or analog video signals are used to drive the display. The actual OLED can be either voltage- or current-driven depending on the circuit used to pass current through the OLED. Again, these techniques are well known in the art.

The correction signals used to modify the input image signal to form a corrected image signal can be used to implement a wide variety of display performance attributes over time. For example, the model used to supply correction signals to an input image signal can hold the average luminance or white point of the display constant. Alternatively, the correction signals used to create the corrected image signal can allow the average luminance to degrade more slowly than it would otherwise due to aging.

In a preferred embodiment, the invention is employed in a display that includes Organic Light Emitting Diodes (OLEDS) which are composed of small molecule or polymeric OLEDs as disclosed in but not limited to U.S. Pat. No. 4,769,292, by Tang et al., and U.S. Pat. No. 5,061,569, by VanSlyke et al. Many combinations and variations of organic light emitting displays can be used to fabricate such a display.

General Display Architecture

The present invention can be employed in most OLED display configurations. These include very simple structures comprising a single anode and cathode to more complex displays, such as passive matrix displays comprised of orthogonal arrays of anodes and cathodes to form light emitting elements, and active-matrix displays where each light emitting element is controlled independently, for example, with thin film transistors (TFTs).

Figure 5:
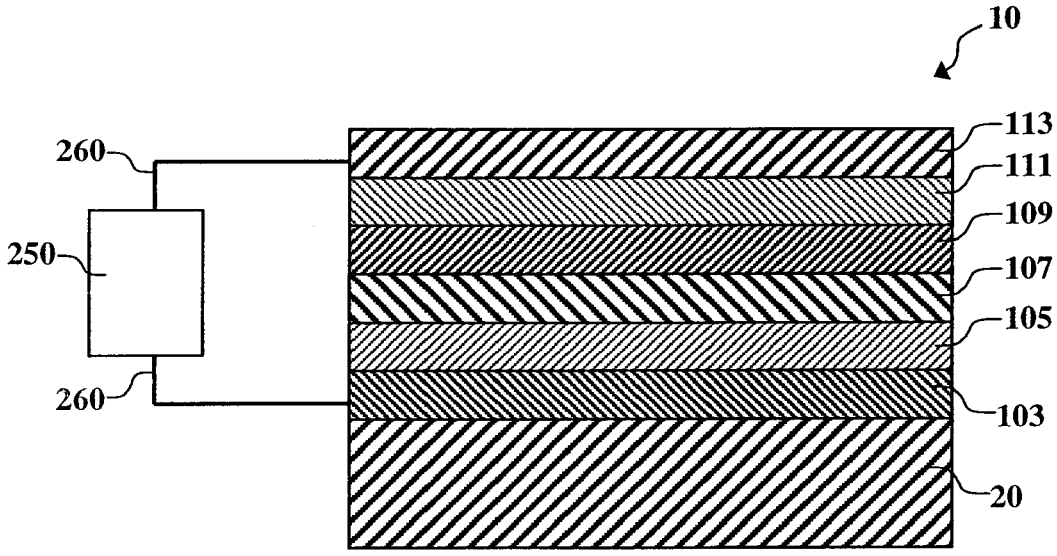
FIG. 5 is a cross-sectional diagram representing the structure of a prior art OLED useful with the present invention.

There are numerous configurations of the organic layers wherein the present invention can be successfully practiced. A typical prior art structure is OLED device 10 shown in FIG. 5 and is comprised of a substrate 20, an anode 103, a hole-injecting layer 105, a hole-transporting layer 107, a light-emitting layer 109, an electron-transporting layer 111, and a cathode 113. These layers are described in detail below. Note that the substrate can alternatively be located adjacent to the cathode, or the substrate can actually constitute the anode or cathode. The organic layers between the anode and cathode are conveniently referred to as the organic EL element. The total combined thickness of the organic layers is preferably less than 500 nm. The device can be top-emitting (light is emitted through cathode 113) or bottom-emitting (light is emitted through anode 103 and substrate 20).

The anode and cathode of the OLED are connected to a voltage/current source 250 through electrical conductors 260. The OLED is operated by applying a potential between the anode and cathode such that the anode is at a more positive potential than the cathode. Holes are injected into the organic EL element from the anode and electrons are injected into the organic EL element at the cathode. Enhanced display stability can sometimes be achieved when the OLED is operated in an AC mode where, for some time period in the cycle, the potential bias is reversed and no current flows. An example of an AC-driven OLED is described in U.S. Pat. No. 5,552,678.

Substrate

The OLED display of this invention is typically provided over a supporting substrate where either the cathode or anode can be in contact with the substrate. The electrode in contact with the substrate is conveniently referred to as the bottom electrode. Conventionally, the bottom electrode is the anode, but this invention is not limited to that configuration. The substrate can either be transmissive or opaque. In the case wherein the substrate is transmissive but the device is top-emitting, a reflective or light absorbing layer can be used to reflect the light or to absorb the light, thereby improving the contrast of the display. Substrates can include, but are not limited to, glass, plastic, semiconductor materials, silicon, ceramics, and circuit board materials.

Anode

When EL emission is viewed through anode 103, the anode should be transparent or substantially transparent to the emission of interest. Common transparent anode materials used in this invention are indium-tin oxide (ITO), indium-zinc oxide (IZO) and tin oxide, but other metal oxides can work including, but not limited to, aluminum- or indium-doped zinc oxide, magnesium-indium oxide, and nickel-tungsten oxide. In addition to these oxides, metal nitrides, such as gallium nitride, and metal selenides, such as zinc selenide, and metal sulfides, such as zinc sulfide, can be used as the anode. For applications where EL emission is viewed only through the cathode electrode, the transmissive characteristics of anode are immaterial and any conductive material can be used, transparent, opaque or reflective. Example conductors for this application include, but are not limited to, gold, iridium, molybdenum, palladium, and platinum. Typical anode materials, transmissive or otherwise, have a work function of 4.1 eV or greater. Desired anode materials are commonly deposited by any suitable way such as evaporation, sputtering, chemical vapor deposition, or electrochemical. Anodes can be patterned using well-known photolithographic processes. Optionally, anodes can be polished prior to application of other layers to reduce surface roughness so as to reduce shorts or enhance reflectivity.

Hole-Injecting Layer (HIL)

While not always necessary, it is often useful to provide a hole-injecting layer 105 between anode 103 and hole-transporting layer 107. The hole-injecting material can serve to improve the film formation property of subsequent organic layers and to facilitate injection of holes into the hole-transporting layer. Suitable materials for use in the hole-injecting layer include, but are not limited to, porphyrinic compounds as described in U.S. Pat. No. 4,720,432, plasma-deposited fluorocarbon polymers as described in U.S. Pat. No. 6,208,075, and some aromatic amines, for example, m-MTDATA (4,4',4"-tris[(3-methylphenyl)phenylamino]triphenylamine). Alternative hole-injecting materials reportedly useful in organic EL displays are described in EP 0 891 121 A1 and EP 1 029 909 A1.

Hole-Transporting Layer (HTL)

The hole-transporting layer 107 contains at least one hole-transporting compound such as an aromatic tertiary amine, where the latter is understood to be a compound containing at least one trivalent nitrogen atom that is bonded only to carbon atoms, at least one of which is a member of an aromatic ring. In one form the aromatic tertiary amine can be an arylamine, such as a monoarylamine, diarylamine, triarylamine, or a polymeric arylamine. Exemplary monomeric triarylamines are illustrated by Klupfel et al. U.S. Pat. No. 3,180,730. Other suitable triarylamines substituted with one or more vinyl radicals and/or comprising at least one active hydrogen containing group are disclosed by Brantley et al U.S. Pat. Nos. 3,567,450 and 3,658,520.

A more preferred class of aromatic tertiary amines are those which include at least two aromatic tertiary amine moieties as described in U.S. Pat. Nos. 4,720,432 and 5,061,569. The hole-transporting layer can be formed of a single or a mixture of aromatic tertiary amine compounds. Illustrative of useful aromatic tertiary amines are the following:

1,1-Bis(4-di-p-tolylaminophenyl)cyclohexane
1,1-Bis(4-di-p-tolylaminophenyl)-4-phenylcyclohexane
4,4'-Bis(diphenylamino)quadriphenyl
Bis(4-dimethylamino-2-methylphenyl)-phenylmethane
N,N,N-Tri(p-tolyl)amine
4-(di-p-tolylamino)-4'-[4(di-p-tolylamino)-styryl] stilbene
N,N,N',N'-Tetra-p-tolyl-4-4'-diaminobiphenyl
N,N,N',N'-Tetraphenyl-4,4'-diaminobiphenyl
N,N,N',N'-tetra-1-naphthyl-4,4'-diaminobiphenyl
N,N,N',N'-tetra-2-naphthyl-4,4'-diaminobiphenyl
N-Phenylcarbazole
4,4'-Bis[N-(1-naphthyl)-N-phenylamino]biphenyl
4,4'-Bis[N-(1-naphthyl)-N-(2-naphthyl)amino]biphenyl
4,4"-Bis[N-(1-naphthyl)-N-phenylamino]p-terphenyl
4,4'-Bis[N-(2-naphthyl)-N-phenylamino]biphenyl
4,4'-Bis[N-(3-acenaphthenyl)-N-phenylamino]biphenyl
1,5-Bis[N-(1-naphthyl)-N-phenylamino]naphthalene
4,4'-Bis[N-(9-anthryl)-N-phenylamino]biphenyl
4,4"-Bis[N-(1-anthryl)-N-phenylamino]-p-terphenyl
4,4'-Bis[N-(2-phenanthryl)-N-phenylamino]biphenyl
4,4'-Bis[N-(8-fluoranthenyl)-N-phenylamino]biphenyl
4,4'-Bis[N-(2-pyrenyl)-N-phenylamino]biphenyl
4,4'-Bis[N-(2-naphthacenyl)-N-phenylamino]biphenyl
4,4'-Bis [N-(2-perylenyl)-N-phenylamino]biphenyl
4,4'-Bis[N-(1-coronenyl)-N-phenylamino]biphenyl
2,6-Bis(di-p-tolylamino)naphthalene
2,6-Bis[di-(1-naphthyl)amino]naphthalene
2,6-Bis[N-(1-naphthyl)-N-(2-naphthyl)amino]naphthalene
N,N,N',N'-Tetra(2-naphthyl)-4,4"-diamino-p-terphenyl
4,4'-Bis{N-phenyl-N-[4-(1-naphthyl)-phenyl]amino} biphenyl
4,4'-Bis[N-phenyl-N-(2-pyrenyl)amino]biphenyl
2,6-Bis[N,N-di(2-naphthyl)amine]fluorene
1,5-Bis[N-(1-naphthyl)-N-phenylamino]naphthalene
4,4',4"-tris[(3-methylphenyl)phenylamino] triphenylamine Another class of useful hole-transporting materials includes polycyclic aromatic compounds as described in EP 1 009 041. Tertiary aromatic amines with more than two amine groups can be used including oligomeric materials. In addition, polymeric hole-transporting materials can be used such as poly(N-vinylcarbazole) (PVK), polythiophenes, polypyrrole, polyaniline, and copolymers such as poly(3,4-ethylenedioxythiophene)/poly(4-styrenesulfonate) also called PEDOT/PSS.

Light-Emitting Layer (LEL)

As more fully described in U.S. Pat. Nos. 4,769,292 and 5,935,721, the light-emitting layer (LEL) 109 of the organic EL element includes a luminescent or fluorescent material where electroluminescence is produced as a result of electron-hole pair recombination in this region. The light-emitting layer can be comprised of a single material, but more commonly consists of a host material doped with a guest compound or compounds where light emission comes primarily from the dopant and can be of any color. The host materials in the light-emitting layer can be an electron-transporting material, as defined below, a hole-transporting material, as defined above, or another material or combination of materials that support hole-electron recombination. The dopant is usually chosen from highly fluorescent dyes, but phosphorescent compounds, e.g., transition metal complexes as described in WO 98/55561, WO 00/18851, WO 00/57676, and WO 00/70655 are also useful. Dopants are typically coated as 0.01 to 10% by weight into the host material. Polymeric materials such as polyfluorenes and polyvinylarylenes (e.g., poly(p-phenylenevinylene), PPV) can also be used as the host material. In this case, small molecule dopants can be molecularly dispersed into the polymeric host, or the dopant can be added by copolymerizing a minor constituent into the host polymer.

An important relationship for choosing a dye as a dopant is a comparison of the bandgap potential which is defined as the energy difference between the highest occupied molecular orbital and the lowest unoccupied molecular orbital of the molecule. For efficient energy transfer from the host to the dopant molecule, a necessary condition is that the band gap of the dopant is smaller than that of the host material. For phosphorescent emitters it is also important that the triplet energy level of the host be high enough to enable energy transfer from host to dopant.

Host and emitting molecules known to be of use include, but are not limited to, those disclosed in U.S. Pat. Nos. 4,768,292; 5,141,671; 5,150,006; 5,151,629; 5,405,709; 5,484,922; 5,593,788; 5,645,948; 5,683,823; 5,755,999; 5,928,802; 5,935,720; 5,935,721; and 6,020,078.

Metal complexes of 8-hydroxyquinoline (oxine) and similar derivatives constitute one class of useful host compounds capable of supporting electroluminescence. Illustrative of useful chelated oxinoid compounds are the following:

CO-1: Aluminum trisoxine [alias, tris(8-quinolinolato) aluminum(III)]

CO-2: Magnesium bisoxine [alias, bis(8-quinolinolato) magnesium(II)]

CO-3: Bis[benzo{f}-8-quinolinolato]zinc (II)

CO-4: Bis(2-methyl-8-quinolinolato)aluminum(III)-μ-oxo-bis(2-methyl-8-quinolinolato)aluminum(III)

CO-5: indium trisoxine [alias, tris(8-quinolinolato)indium]

CO-6: Aluminum tris(5-methyloxine)[alias, tris(5-methyl-8-quinolinolato) aluminum(III)]

CO-7: Lithium oxine [alias, (8-quinolinolato)lithium(I)]

CO-8: Gallium oxine [alias, tris(8-quinolinolato) gallium (III)]

CO-9: Zirconium oxine [alias, tetra(8-quinolinolato) zirconium(IV)]

Other classes of useful host materials include, but are not limited to: derivatives of anthracene, such as 9,10-di-(2-naphthyl) anthracene and derivatives thereof as described in U.S. Pat. No. 5,935,721, distyrylarylene derivatives as described in U.S. Pat. No. 5,121,029, and benzazole derivatives, for example, 2,2',2"-(1,3,5-phenylene)tris[1-phenyl-1H-benzimidazole]. Carbazole derivatives are particularly useful hosts for phosphorescent emitters.

Useful fluorescent dopants include, but are not limited to, derivatives of anthracene, tetracene, xanthene, perylene, rubrene, coumarin, rhodamine, and quinacridone, dicyanomethylenepyran compounds, thiopyran compounds, polymethine compounds, pyrilium and thiapyrilium compounds, fluorene derivatives, periflanthene derivatives, indenoperylene derivatives, bis(azinyl)amine boron compounds, bis(azinyl)methane compounds, and carbostyryl compounds.

Electron-Transporting Layer (ETL)

Preferred thin film-forming materials for use in forming the electron-transporting layer 111 of the organic EL elements of this invention are metal chelated oxinoid compounds, including chelates of oxine itself (also commonly referred to as 8-quinolinol or 8-hydroxyquinoline). Such compounds help to inject and transport electrons, exhibit high levels of performance, and are readily fabricated in the form of thin films. Exemplary oxinoid compounds were listed above.

Other electron-transporting materials include various butadiene derivatives as disclosed in U.S. Pat. No. 4,356,429 and various heterocyclic optical brighteners as described in U.S. Pat. No. 4,539,507. Benzazoles and triazines are also useful electron-transporting materials.

Cathode

When light emission is viewed solely through the anode, the cathode 113 used in this invention can be comprised of nearly any conductive material. Desirable materials have good film-forming properties to ensure good contact with the underlying organic layer, promote electron injection at low voltage, and have good stability. Useful cathode materials often contain a low work function metal (<4.0 eV) or metal alloy. One preferred cathode material is comprised of a Mg:Ag alloy wherein the percentage of silver is in the range of 1 to 20%, as described in U.S. Pat. No. 4,885,221. Another suitable class of cathode materials includes bilayers comprising a thin electron-injection layer (EIL) in contact with the organic layer (e.g., ETL) which is capped with a thicker layer of a conductive metal. Here, the EIL preferably includes a low work function metal or metal salt, and if so, the thicker capping layer does not need to have a low work function. One such cathode is comprised of a thin layer of LiF followed by a thicker layer of A1 as described in U.S. Pat. No. 5,677,572. Other useful cathode material sets include, but are not limited to, those disclosed in U.S. Pat. Nos. 5,059,861, 5,059,862, and 6,140,763.

When light emission is viewed through the cathode, the cathode must be transparent or nearly transparent. For such applications, metals must be thin or one must use transparent conductive oxides, or a combination of these materials. Optically transparent cathodes have been described in more detail in U.S. Pat. No. 4,885,211, U.S. Pat. No. 5,247,190, U.S. Pat. No. 5,703,436, U.S. Pat. No. 5,608,287, U.S. Pat. No. 5,837,391, U.S. Pat. No. 5,677,572, U.S. Pat. No. 5,776,622, U.S. Pat. No. 5,776,623, U.S. Pat. No. 5,714,838, U.S. Pat. No. 5,969,474, U.S. Pat. No. 5,739,545, U.S. Pat. No. 5,981,306, U.S. Pat. No. 6,137,223, U.S. Pat. No. 6,140,763, U.S. Pat. No. 6,172,459, EP 1 076 368, U.S. Pat. No. 6,278,236, and U.S. Pat. No. 6,284,393. Cathode materials are typically deposited by evaporation, sputtering, or chemical vapor deposition. When needed, patterning can be achieved through many well known methods including, but not limited to, through-mask deposition, integral shadow masking, for example, as described in U.S. Pat. No. 5,276,380 and EP 0 732 868, laser ablation, and selective chemical vapor deposition.

Other Common Organic Layers and Display Architecture

In some instances, layers 109 and 111 can optionally be collapsed into a single layer that serves the function of supporting both light emission and electron transportation. It also known in the art that light-emitting dopants can be added to the hole-transporting layer, which can serve as a host. Multiple dopants can be added to one or more layers in order to create a white-emitting OLED, for example, by combining blue- and yellow-emitting materials, cyan- and red-emitting materials, or red-, green-, and blue-emitting materials. White-emitting displays are described, for example, in EP 1 187 235, U.S. 2002/0025419, EP 1 182 244, U.S. Pat. No. 5,683,823, U.S. Pat. No. 5,503,910, U.S. Pat. No. 5,405,709, and U.S. Pat. No. 5,283,182.

Additional layers such as electron- or hole-blocking layers as taught in the art can be employed in displays of this invention. Hole-blocking layers are commonly used to improve efficiency of phosphorescent emitter displays, for example, as in U.S. 2002/0015859.

This invention can be used in so-called stacked display architecture, for example, as taught in U.S. Pat. No. 5,703,436 and U.S. Pat. No. 6,337,492.

Deposition of Organic Layers

The organic materials mentioned above are suitably deposited through a vapor-phase method such as sublimation, but can be deposited from a fluid, for example, from a solvent with an optional binder to improve film formation. If the material is a polymer, solvent deposition is useful but other methods can be used, such as sputtering or thermal transfer from a donor sheet. The material to be deposited by sublimation can be vaporized from a sublimator "boat" often comprised of a tantalum material, e.g., as described in U.S. Pat. No. 6,237,529, or can be first coated onto a donor sheet and then sublimed in closer proximity to the substrate. Layers with a mixture of materials can utilize separate sublimator boats or the materials can be pre-mixed and coated from a single boat or donor sheet. Patterned deposition can be achieved using shadow masks, integral shadow masks (U.S. Pat. No. 5,294,870), spatially-defined thermal dye transfer from a donor sheet (U.S. Pat. Nos. 5,688,551, 5,851,709 and 6,066,357) and inkjet methods (U.S. Pat. No. 6,066,357).

Encapsulation

Most OLED displays are sensitive to moisture or oxygen, or both, so they are commonly sealed in an inert atmosphere such as nitrogen or argon, along with a desiccant such as alumina, bauxite, calcium sulfate, clays, silica gel, zeolites, alkaline metal oxides, alkaline earth metal oxides, sulfates, or metal halides and perchlorates. Methods for encapsulation and desiccation include, but are not limited to, those described in U.S. Pat. No. 6,226,890. In addition, barrier layers such as SiOx, Teflon, and alternating inorganic/polymeric layers are known in the art for encapsulation.

Optical Optimization

OLED displays of this invention can employ various well-known optical effects in order to enhance its properties if desired. This includes changing layer thicknesses to yield high light transmission, providing dielectric mirror structures, replacing reflective electrodes with light-absorbing electrodes, providing anti-glare or anti-reflection coatings over the display, providing a polarizing medium over the display, or providing colored, neutral density, or color conversion filters over the display. Filters, polarizers, and anti-glare or anti-reflection coatings can be specifically provided over the cover or an electrode protection layer beneath the cover.

The invention has been described in detail with particular reference to certain preferred embodiments thereof, but it will be understood that variations and modifications can be effected within the spirit and scope of the invention.

PARTS LIST

8 drive circuit
10 OLED device
11 power supply
12 switch transistor
13 drive transistor
14 first parameter signal
15 switch transistor
16 controller
18 current measurement device
19 second parameter signal
20 substrate
22 array
23 thermocouple
24 data line
25 corrected control signals
26 input signals
28 select line
32 gate electrode
40 $dV_{th}$
42 $dV_{OLED}$
50 apply input signal
52 measure OLED voltage, current, luminance
54 store measurements
56 process repeated
57 series of steps repeated
58 create lookup table or algorithm
60 apply input signal
62 measure OLED voltage, and current
64 lookup correction for OLED efficiency
66 form corrected signal
68 apply corrected signal
103 anode
105 hole injecting layer
107 hole transporting layer
109 light emitting layer
111 electron-transporting layer
113 cathode
250 voltage/current source
260 electrical conductors

The invention claimed is:

1. A compensated drive circuit adjusting for changes in the threshold voltage of a drive transistor and for aging of an OLED device, comprising:

a. a data line carrying analog data representative of the brightness level desired from the OLED device, and a select line;

b. the drive transistor connected to a power supply and to the OLED device such that when the select line is activated and a voltage from the data line is applied to the gate electrode of such transistor, current proportional to the applied voltage will flow through the drain and source electrodes through the OLED device;

c. means for measuring first and second parameters associated with the drive circuitry, the first parameter being a function of the voltage across the OLED device, and the second parameter being a function of the current passing through the OLED device; and d. means responsive to the measured first and second parameters for computing offset voltages to be applied to the data line analog voltages to adjust for changes in the threshold voltage of the drive transistors and for aging of the OLED device.

2. The drive circuit of claim 1 wherein the drive transistor is an amorphous silicon transistor.

3. The OLED device of claim 1, wherein the responsive means further includes a lookup table having an offset voltage for each of the OLED devices.

4. The OLED device of claim 1, wherein the responsive means sequentially activates individual OLED devices to measure the first and second parameters associated with each OLED device.

5. The OLED device of claim 1, wherein the responsive means activates one or more OLED devices at a plurality of different brightness levels to compute the offset voltage.

6. A method of adjusting for changes in the threshold voltage of the drive transistor and aging of an OLED device, comprising:

a. providing a data line carrying analog data representative of the brightness level desired from the OLED device, and a select line;

b. providing a drive transistor connected to a power supply and to the OLED device such that when the select line is activated and a voltage from the data line is applied to the gate electrode of such transistor, current proportional to the applied voltage will flow through the drain and source electrodes through the OLED device;

c. measuring first and second parameters associated with the drive transistor and the OLED device, wherein the first parameter is a function of the voltage across the OLED device, and the second parameter is a function of the current passing through the drive transistor and the OLED device; and d. computing offset voltages applied to the data line analog voltages for adjusting for changes in the threshold voltage of the drive transistors and aging of the OLED device.

* * * * *